United States Patent [19]

Fujioka et al.

[11] Patent Number: 4,962,374

[45] Date of Patent: Oct. 9, 1990

[54] THIN FILM EL DISPLAY PANEL DRIVE CIRCUIT

[75] Inventors: Yosihide Fujioka, Nara; Yoshiharu Kanatani, Nara; Toshihiro Ohba, Nara; Hisashi Uede, Wakayama, all of Japan

[73] Assignee: Sharp Kabushiki Kaisha, Osaka, Japan

[21] Appl. No.: 372,136

[22] Filed: Jun. 26, 1989

Related U.S. Application Data

[63] Continuation of Ser. No. 942,398, Dec. 16, 1936, abandoned.

[30] Foreign Application Priority Data

Dec. 17, 1985 [JP] Japan ..... 60-286242

[51] Int. Cl.[5] ..... G09G 3/12

[52] U.S. Cl. ..... 340/781; 315/169.2; 315/169.3

[58] Field of Search ..... 340/718, 719, 781, 801, 340/825.81; 315/169.2, 169.3

[56] References Cited

U.S. PATENT DOCUMENTS 4,456,909 6/1984 Takahara et al. ..... 340/781
4,488,150 12/1984 Kanatani ..... 340/781
4,594,589 6/1986 Ohba et al. ..... 340/781
4,636,789 1/1987 Yamaguchi et al. ..... 340/781
4,652,872 3/1987 Fujita ..... 340/781

FOREIGN PATENT DOCUMENTS 3511886 3/1985 Fed. Rep. of Germany .
3619366 11/1986 Fed. Rep. of Germany .
2158982 11/1985 United Kingdom ..... 340/781

*Primary Examiner*—Jeffery A. Brier

[57] ABSTRACT

A thin film electroluminescent (EL) display panel drive circuit includes first and second switching circuits for driving scanning electrodes of the panel in two fields, wherein odd numbered scanning electrodes are applied with a negative voltage polarity and even numbered scanning electrodes are provided with a positive voltage polarity in a first field, and the voltage polarities are reversed during the second field. Data signals are applied to data electrodes by a data electrode driver circuit which includes third and fourth switching circuits for providing selected data electrodes with a modulate voltage of a stepwise nature or ground, depending upon whether the selected data electrodes intersect with selected scanning electrodes having a negative or positive voltage polarity respectively. The stepwise modulation voltage is supplied by a control switching circuit which selectively supplies the third switching circuit with voltages of a first level, a second level and a floating level.

6 Claims, 5 Drawing Sheets

THIN FILM EL DISPLAY PANEL DRIVE CIRCUIT

This application is a continuation of application Ser. No. 06/942,398 filed on Dec. 16, 1986, now abandoned.

Background of the Invention

1. Field of the Invention

The present invention relates to an AC driven capacitive flat matrix display panel, that is, a drive circuit for a thin film EL display panel.

2. Description of the Related Art

The construction of a double insulation (or three-layered) thin film EL display panel is described below with reference to FIG. 1.

Strips of transparent electrode (2) composed of $In_2O_3$ pl are placed parallel to one another on a glass substrate (1). Then a dielectric layer (3) composed of $Y_2O_3$, $Si_3N_4$, $TiO_2$, or $Al_2O_3$, an EL layer (4) composed of ZnS doped with an activating agent such as Mn, and another dielectric layer (3') composed of $Y_2O_3$, $Si_3N_4$, $TiO_2$, or $Al_2O_3$, each layer having a thickness of between 500 and 10,000Å, are deposited in turn by a thin film technology method such as evaporation or sputtering on the transparent electrodes (2) to form the three-layered construction. Finally, strips of counter electrode (5) composed of $Al_2O_3$ are provided, at right angles to the transparent electrode (2), on top of the three-layered construction. The thin film EL element thus obtained is considered as a capacitive element in terms of circuit equivalence because the EL layer (4) clamped between the two dielectric layers (3) and (3') is placed between the electrodes. As is obvious from the voltage-to-brightness characteristics shown in FIG. 2, the thin film EL element is driven by a relatively large voltage on the order of 200 V.

The above thin film EL element features high-luminance illumination by an AC electric field and a durable service life as well. In the normal operation of conventional thin film EL display panels, each of the data-side electrodes is connected to a diode applying a one-half modulated voltage VM and a switching circuit discharging the applied voltage until 0 V is reached. In addition, the above thin film EL display panel is also provided with an N-ch MOS driver and a P-ch MOS driver for field reversal and reversal of the polarity of write waveforms applied to picture elements in each scanning line. However, with the proposed drive circuit, the scanning period of a scanning line includes three different drive periods; as a result at least 50 μs are required for sufficiently high luminance of one scanning line. Accordingly, when the number of scanning-side electrodes is increased, it is necessary to use a lower frame frequency, resulting in a picture of poor quality with flicker and low luminance.

To minimize the above defects, the present inventors propose a novel drive circuit in a co-pending U.S. Pat. Application S.N. 864,509, "THIN FILM EL DISPLAY PANEL DRIVE CIRCUIT," filed on May 19, 1986, wherein each of the data-side electrodes is connected to a third switching circuit, which charges EL layers, and a fourth switching circuit, which discharges a specific voltage from these layers. Each of these data-side electrodes is connected to a diode in the reverse direction of the charging or discharging direction to allow the data-side electrodes to simultaneously charge and discharge a specific voltage in accordance with the display data during the write drive period. In other words, modulation drive can be performed simultaneous with the write drive operation to eventually shorten the driving period of each scanning line to about 40 μs. Thus, when displaying data using the identical frame frequency, a novel EL display panel having more scanning-side electrodes than conventional drive systems have can be driven satisfactorily. The corresponding British Pat. Application was filed on June 10, 1986, and assigned Application No. 8614090. The German counterpart is P3619366.6, filed on June 9, 1986.

Even in the above proposal, however, as the number of scanning lines of the thin film EL display panel increases in conjunction with expanded display capacity, the synthetic capacity of all of the picture elements increases itself. Since the increase in the number of scanning lines results in an increase of charge-discharge cycles within a specific period of time (i.e., one field), power consumption is also increased significantly while modulation drive is underway. Furthermore, since charging is performed instantly either from modulated voltage VM to 0 V or from 0 V to VM, a greater amount of power is unavoidably consumed while modulation drive is underway.

Objects and Summary of the Invention

Objects of the Invention

In view of the foregoing, the object of the present invention is to provide an EL display panel drive circuit which significantly saves power consumption in modulation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Summary of the Invention

The thin film EL display panel drive circuit embodying the present invention contains an EL layer between scanning-side electrodes and data-side electrodes arranged at right angles to each other. Each of the scanning-side electrodes is connected to a first switching circuit and a second switching circuit applying voltages to the scanning side electrodes of negative and positive polarities, respectively, with respect to the voltage of the data-side electrodes. The common line of the first switching circuit is connected to a fifth switching circuit that turns a specific voltage into a negative write voltage or 0 V, and the common line of the second switching circuit is connected to a sixth switching circuit that turns a specific voltage into a positive write voltage or 0 V. Each of the data-side electrodes is connected to a third switching circuit that charges EL layers corresponding to the scanning-side electrodes and also to a fourth switching circuit that discharges a specific voltage from those EL layers. The common line of the third switching circuit is connected to a seventh switching circuit that changes the common line into three states —floating, modulated voltage VM, and one-half VM.

Brief Description of the Drawings

The present invention will become more fully understood from the detailed description given hereinbelow and the accompanying drawings which are given by way of illustration only, and thus are not limitative of the present invention and wherein.

Description of the Preferred Embodiments

Figure 1:
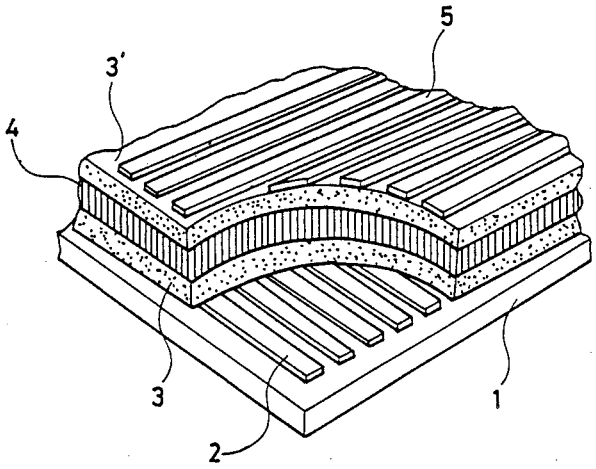
FIG. 1 is a partially cut-away perspective view of a thin film EL display panel.
Figure 2:
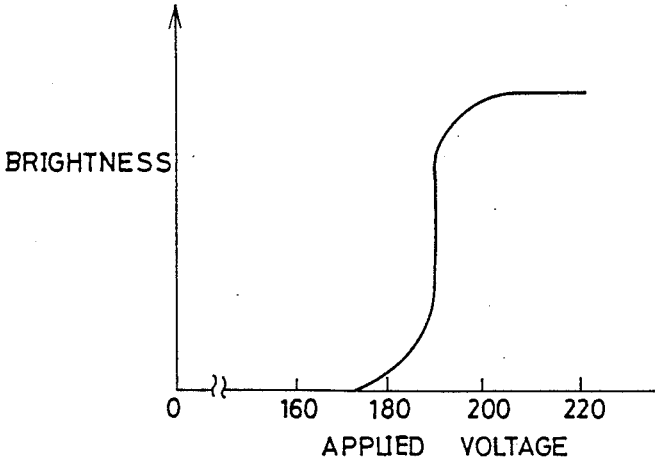
FIG. 2 is a graph showing the voltage-to-brightness characteristics of the film EL display panel of FIG. 1.
Figure 3:
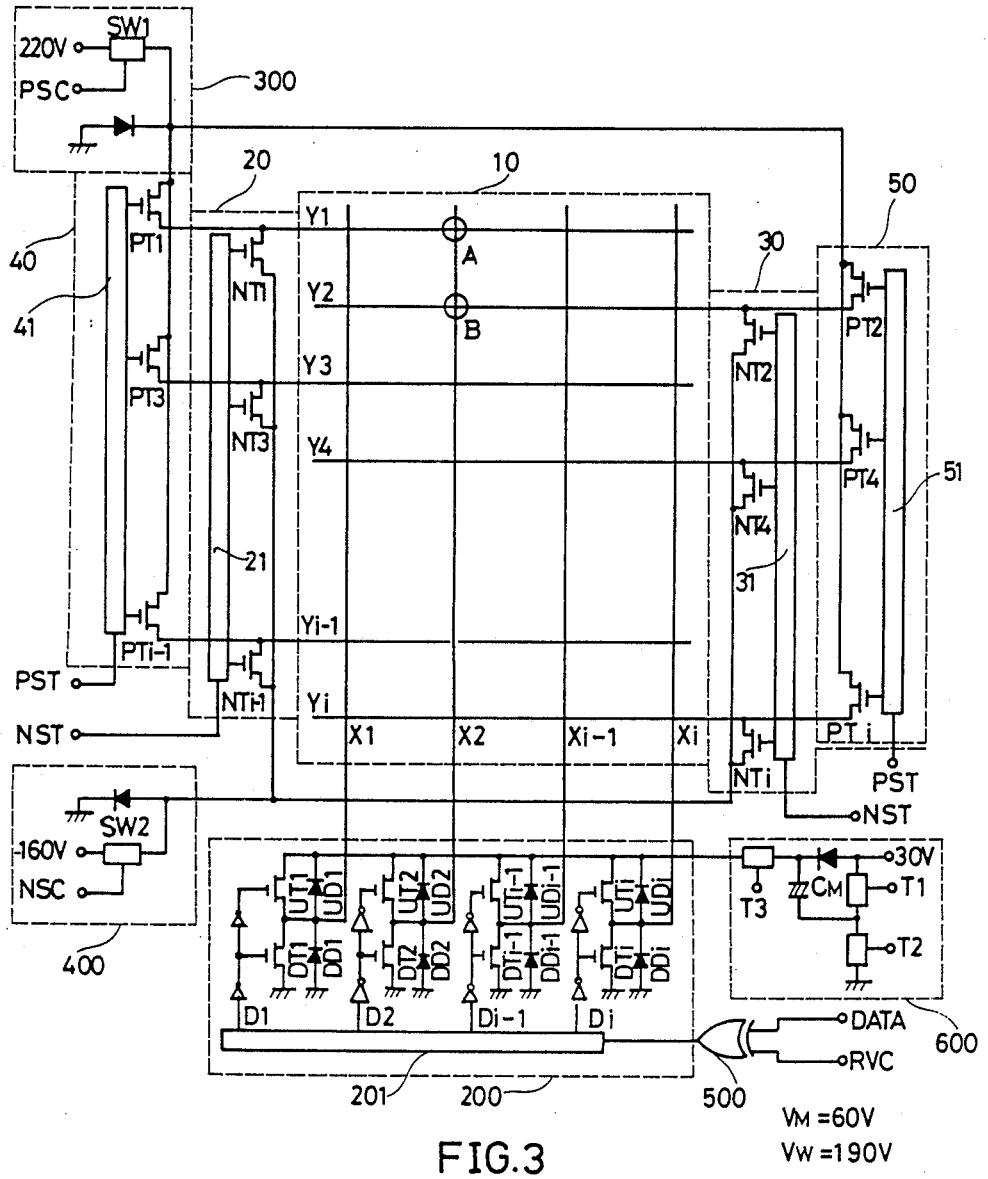
FIG. 3 is an electric circuit diagram showing an embodiment of the present invention.

FIG. 3 is an electric circuit diagram of an embodiment of the present invention. (10) is a thin film EL display panel with an emitting threshold voltage of VW (=190 V) in which data-side electrodes are arranged in the X direction and scanning-side electrodes are arranged in the Y direction. (20) and (30) are scanning-side N-ch high voltage MOS IC's (composing the first switching circuit) corresponding to scanning-side electrodes on odd lines and even lines, respectively. (21) and (31) are logic circuits such as shift registers in the MOS IC's (20) and (30), respectively. (40) and (50) are scanning-side P-ch high voltage MOS IC's (composing the second switching circuit) corresponding to the scanning-side electrodes on odd lines and even lines, respectively. (41) and (51) are logic circuits such as shift registers in the MOS IC's (40) and (50), respectively. (200) is a data-side electrode driver IC. The driver comprises transistors (UT1) through (UTi) with pull-up function (composing the third switching circuit), the end of each of which is connected to a power source of voltage VM (=60 V); transistors (DT1) through (DTi) with pull-down function (composing the fourth switching circuit), the end of each of which is grounded; and diodes (UD1) through (UDi) and (DD1) through (DDi) for applying current in the reverse direction from the currents of the transistors (UT1) through (UTi) and (DT1) through (DTi), respectively. These components in the driver are controlled by a logic circuit (201) such as a shift register provided in the driver IC (200). (300) is a source potential selector circuit for the scanning-side P-ch high voltage MOS IC's corresponding to the sixth switching circuit.) A potential of 220 V ($=VW+\frac{1}{2}.VM$) or 0 V is selected by a switch (SW1) that is operated by a signal (PSC).

(400) is a source potential selector circuit for the scanning-side N-ch high voltage MOS IC's corresponding to the fifth switching circuit). A potential of −160 V ($=-VM+\frac{1}{2}.VM$) or 0 V is selected by a switch (SW2) that is operated by a signal (NSC). (500) is a data reversal control circuit. (600) is a Vcc2 control circuit (corresponding to the seventh switching circuit) that controls the common line (Vcc2) of (UT1) through (UTi) and (UD1) through (UDi) inside the data-side electrode driver IC (200). A modulated voltage potential of 30 V ($\frac{1}{2}.VM$) or 60 V (VM) is selected by two switches (T1) and (T2): With switch (T1) OFF and switch (T2) ON, a 30 V potential is selected; with switch (T1) ON and (T2) OFF, a 60 V potential is selected. Switch (T3) switches Vcc2 either to a specific potential controlled by switches (T1) and (T2) or to the floating state.

Next, the operation mode of the circuit of FIG. 3 is described with reference to the time chart of FIG. 4. In the description, it is assumed that the scanning-side electrodes Y1 and Y2, each including picture elements (A) and (B) respectively are selected by a line sequential drive. In this drive circuit, the voltage applied to picture elements reverses polarity every line. The timing for applying a negative write pulse to the picture element in a selected electrode line by turning ON the transistor in the N-ch high voltage MOS IC (20) or (30) connected to the selected scanning-side electrode line is called N-ch drive timing. The timing for applying a positive write pulse to the picture element in a selected electrode line by turning ON the transistor in the P-ch high voltage MOS IC (40) or (50) connected to the selected scanning-side electrode line is called P-ch drive timing.

A field in which N-ch drive is performed for the scanning-side electrodes on odd lines and P-ch drive for those on even lines is called the NP field. A field in which P-ch drive is performed for the scanning-side electrodes on odd lines and N-ch drive for those on even lines is called the PN field.

Figure 4:
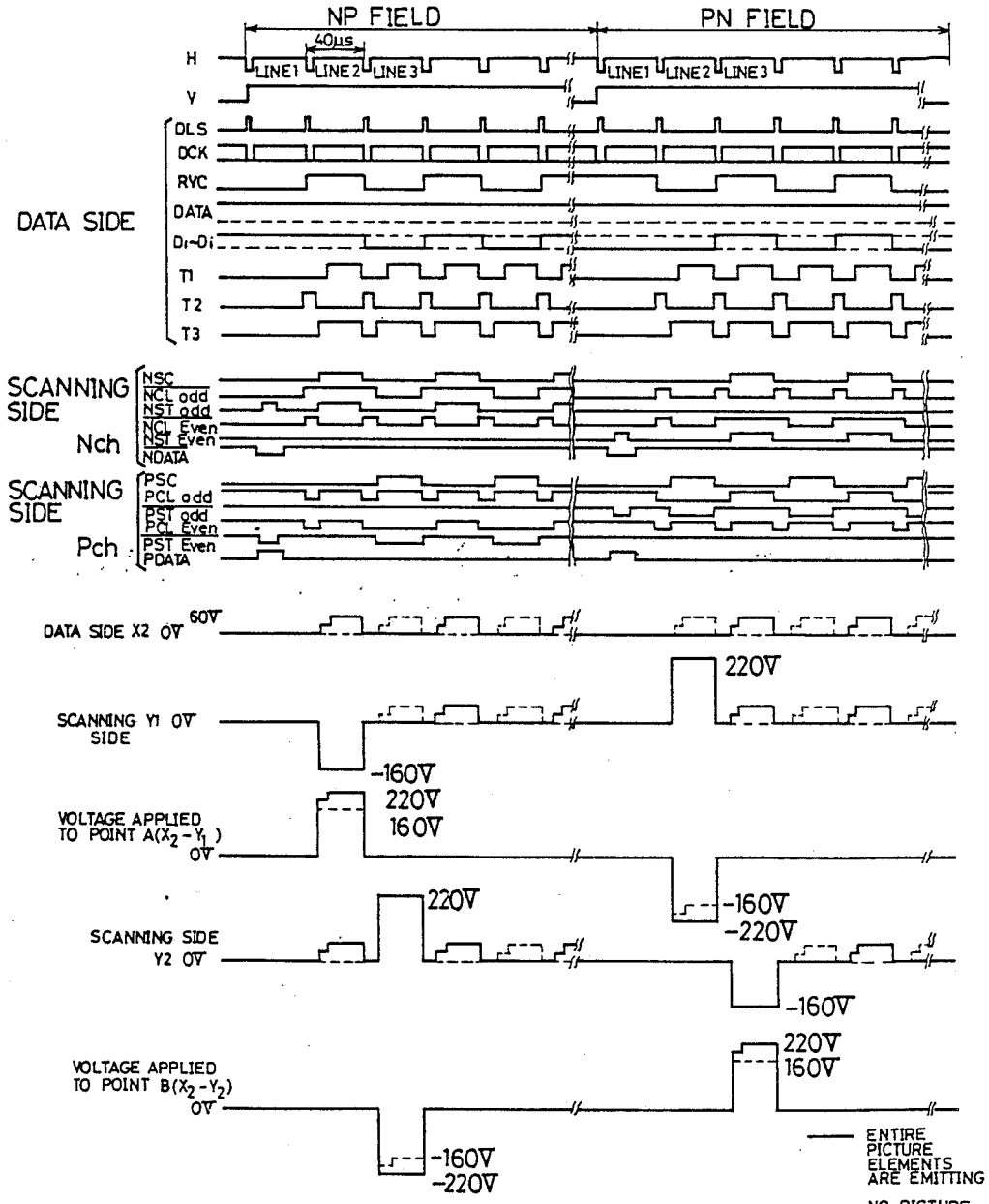
FIG. 4 is a time chart for explaining the operation mode of the circuit of FIG. 3.

Referring to FIG. 4, H is a horizontal synchronization signal in which data is effective during the high periods. V is a vertical synchronization signal. The drive for one frame starts at the rising edge of the vertical synchronization signal. DLS is a data latch signal which is output every time the data for one line has been transmitted. DCK is a data-transmitting clock on the data side. RVC is a data reversal signal that is high during the data transmission period of the electrode line for which P-ch drive is conducted. It reverses all the data during the high period. DATA is a display data signal. D1 ~ Di are data input to the transistors of the data-side electrode driver IC (200). For other signals, refer to Table 1 below.

TABLE 1

| | |
|---|---|
| NSC | Control signal for the source potential selector circuit (400) for the N-ch high voltage MOS IC's |
| $\overline{\text{NCLodd}}$ | CLEAR signal for the N-ch high voltage MOS IC for the odd lines |
| NSTodd | STROBE signal for the N-ch high voltage MOS IC for the odd lines |
| $\overline{\text{NCLeven}}$ | CLEAR signal for the N-ch high voltage MOS IC for the even lines |
| NSTeven | STROBE signal for the N-ch high voltage MOS IC for the even lines |
| $\overline{\text{NDATA}}$ | Transmission data for the N-ch high voltage MOS IC's |
| PSC | Control signal for the source potential selector circuit (300) for the P-ch high voltage MOS IC's |
| PCLodd | CLEAR signal for the P-ch high voltage MOS IC for the odd lines |
| PSTodd | STROBE signal for the P-ch high voltage MOS IC for the odd lines |
| PCLeven | CLEAR signal for the P-ch high voltage MOS IC for the even lines |
| $\overline{\text{PSTeven}}$ | STROBE signal for the P-ch high voltage MOS IC for the even lines |
| PDATA | Transmission data for the P-ch high voltage MOS IC's |
| CLOCK | Scanning-side data-transmitting clock |

In principle, the data-side electrodes are driven by switching over the voltage applied to the data-side electrode lines between VM (=60 V) and 0 V, at cycles of one horizontal period according to the display data (H: luminous, L: non-luminous).

Figure 5:
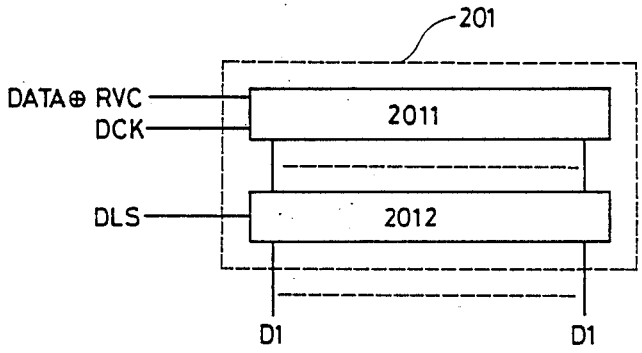
FIGS. 5, 6, and 7 are charts for explaining the logic circuit of FIG. 3.

The voltage switch-over timing is described now with reference to FIG. 5, which shows the internal construction of the logic circuit (201). While a certain data-side electrode line is being driven, outputs of EXCLUSIVE-OR between the display data (H: luminous, L: non-luminous) for the subsequent electrodes and the signal RVC are sequentially input into the shift register (2011) with memory capacity for one line. Upon the completion of data transmission for one line, the EXCLUSIVE-OR inputs, (DATA) +(RVC), in the shift register are transferred by the signal input DLS into a latch circuit (2012) and stored there until the end of the present drive timing. The transistors (UT1) through (UTi) and (DTi) through (DTi) are controlled by the output of the latch circuit (2012). Accordingly, voltage applied to the data-side electrodes is switched over at the cycle of one horizontal period for each signal input of DLS.

The drive circuit related to the present invention does not apply VM (=60 V) instantly when transistor (UTn) is switched ON; rather, the common line control circuit (600) executes a step-by-step driving operation, raising the voltage from ½VM (=30 V) to VM (=60 V). This saves power consumption during modulation to three-quarters of the previously required amount.

The signal RVC is high during the data transmission period for the line for which P-ch drive is performed. During this period, the signal reverses data by the following method: In the P-ch drive, as mentioned later, the transistors of the P-ch high voltage MOS IC's (40) or (50) are turned ON to raise voltage for the selected scanning-side electrode line to (VW+½.VM) (=220 V) and reduce the voltage for the selected data-side electrode line to 0 V so that a voltage of (VW+½.VM) is applied to the picture element for luminous emission. Meanwhile, voltage for the electrode lines not selected is maintained at VM (=60 V) so that a voltage of (VW+½.VM) - VM=160 V is applied to the picture elements. Since this voltage value is below the threshold for luminous emission, the picture elements do not emit light. To achieve the P-ch drive, the transistor (UTn) connected to the selected data-side electrode line N is turned OFF and the transistor (DTn) turned ON. For the electrode line M which is not selected, the transistor (UTm) is turned ON while the transistor (DTm) is turned OFF. In other words, the data input for the selected line, Dn, must be low and that for the line not selected, Dm, must be high. Since this is a reversal from the display data input (H: luminous, L: non-luminous), the signal RVC for inverting data is required. The wave-form of voltage applied to the data-side electrodes thus driven is indicated by X2 in FIG. 4. The solid line shows the waveform when all the picture elements are emitting, and the broken line shows the waveform when no picture element is emitting.

Figure 6:
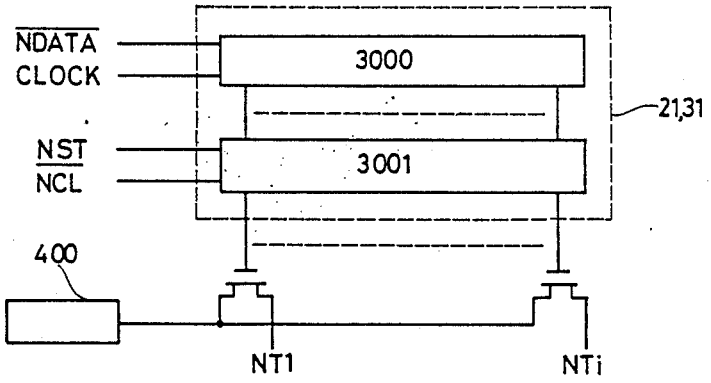
Figure 7:
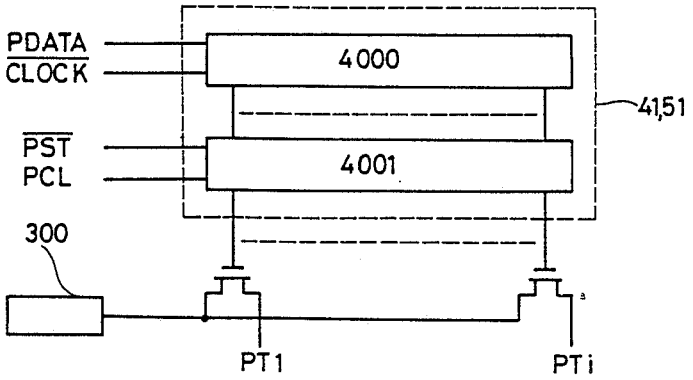

The drive method for the scanning-side electrodes is described next. The internal constructions of the logic circuits (21) and (31) in the N-ch high voltage MOS IC's (20) and (30) are shown in FIG. 6, and those of the logic circuits (41) and (51) in the P-ch high voltage MOS IC's (40) and (50) are shown in FIG. 7. The truth tables for the respective logic circuits are shown in Tables 2 and 3. The constructions of the N-ch high voltage MOS IC's and P-ch high voltage MOS IC's are complementary to each other. Although they have reverse logics, they have identical constructions. Therefore, only the N-ch high voltage MOS IC's (20) and (30) are described here.

TABLE 2

N-ch MOSIC Truth Table

| $\overline{NDATA}$ | $\overline{NCL}$ | NST | Transistor |
|---|---|---|---|
| X | L | X | OFF |
| X | H | L | ON |
| L | H | H | ON |
| H | H | H | OFF |

TABLE 3

N-ch MOSIC Truth Table

| PDATA | PCL | $\overline{PST}$ | Transistor |
|---|---|---|---|
| X | H | X | OFF |
| X | L | H | ON |
| H | L | L | ON |
| L | L | L | OFF |

A shift register (3000) stores a selected scanning-side electrode line. It receives the signal $\overline{NDATA}$ during the high period and transfers it during the low period of the CLOCK signal. In this drive circuit, the signals NSTodd and NSTeven are respectively supplied to the N-ch high voltage MOS IC (20) for odd lines and to the N-ch high voltage MOS IC (30) for even lines as CLOCK signals, as shown in FIG. 4. The NDATA signal input to the shift register (3000) has only one low portion in a frame; the low portion coincides with the first high period of the CLOCK signal (NSTodd) or (NSTeven) input after the rising edge of the signal V, as shown in FIG. 4. Thus, one CLOCK signal (NSTodd) or (NSTeven) is input for every two horizontal periods because N-ch or P-ch drive is alternately conducted for each line. Therefore, the CLOCK signal inputs into the N-ch high voltage MOS IC's and into the P-ch high voltage MOS IC's are staggered in phase by one horizontal period. In the NP field, pulse signals are supplied only for the signal (NSTodd) (=CLOCKodd) to effect N-ch drive for odd lines. In the PN field, they are supplied only for the signal (NSTeven) (=CLOCKeven) to effect N-ch drive for even lines.

A logic circuit (3001) uses two signals (NST) and (NCL) to switch into one of three states: the high voltage MOS IC transistors ON, the transistors OFF, or a state according to the data from the shift register (3000), whose logic is based on the truth table of Table 2. The above operation is summarized in Table 4.

TABLE 4

Drive Timing Chart

| | NP Field | | | | PN Field | | | |
|---|---|---|---|---|---|---|---|---|
| | Driving | | | | | | | |
| | Nch | | Pch | | Pch | | Nch | |
| | Selected line | | | | | | | |
| | Odd line | | Even line | | Odd line | | Even line | |
| Timing | Discharge | Write | Discharge | Write | Discharge | Write | Discharge | Write |
| N-ch Source | 0 V | −160 V | 0 V | 0 V | 0 V | 0 V | 0 V | −160 V |

TABLE 4-continued

| | Drive Timing Chart | | | | | | | |
|---|---|---|---|---|---|---|---|---|
| | NP Field | | | | PN Field | | | |
| | Driving | | | | | | | |
| | Nch | | Pch | | Pch | | Nch | |
| | Selected line | | | | | | | |
| | Odd line | | Even line | | Odd line | | Even line | |
| Timing | Discharge | Write | Discharge | Write | Discharge | Write | Discharge | Write |
| Potential P-ch Source | 0 V | 0 V | 0 V | H0 V 220 | V | 0 V 0 | V | |
| Potential | | | | | | | | |
| NSC | OFF | ON | OFF | OFF | OFF | OFF | OFF | ON |
| PSC | OFF | OFF | OFF | ON | OFF | ON | OFF | OFF |
| NTodd | ON | (ON) | ON | OFF | ON | OFF | ON | OFF |
| NTeven | ON | OFF | ON | OFF | ON | OFF | ON | (ON) |
| PTodd | ON | OFF | ON | OFF | ON | (ON) | ON | OFF |
| PTeven | ON | OFF | ON | (ON) | ON | OFF | ON | OFF |
| $\overline{\text{NCLodd}}$ | H | H | H | L | H | L | H | L |
| NSTodd | L | H | L | L | L | L | L | L |
| $\overline{\text{NCLeven}}$ | H | L | H | L | H | L | H | H |
| NSTeven | L | L | L | L | L | L | L | H |
| PCLodd | L | H | L | H | L | L | L | H |
| $\overline{\text{PSTodd}}$ | H | H | H | H | H | L | H | H |
| PCLeven | L | H | L | L | L | H | L | H |
| $\overline{\text{PSTeven}}$ | H | H | H | L | H | H | H | H |

Note:
(ON) indicates only the selected line is turned ON, and others are OFF.

As understood from the above, the operation of the drive circuit of the present invention is roughly divided into two timing blocks: the NP filed and the PN field. When operation for the two fields has been completed, an AC pulse required for luminous emission is closed for every picture element of the thin film EL display panel. Each field is further divided into two timing blocks: N-ch drive and P-ch drive. In the NP field, N-ch drive is performed for the scanning-side electrode on the selected odd line and P-ch drive for the electrode on the selected even line, and vice versa in the PN field. Each drive (N-ch and P-ch) further includes a discharge period and a write period. The discharge period is about 10 μsec. and the write period is 30 μsec., so one horizontal period is about 40 μsec.

The N-ch source potential and P-ch source potential are source potentials for the N-ch and P-ch high voltage MOS IC transistors, respectively, necessary for applying perfectly symmetrical AC waveforms of amplitude sufficiently large for luminous emission to the EL display elements in the NP and PN fields.

(NSC) is a control signal for the source potential selector circuit (400) for the N-ch high voltage MOS IC's. When (NSC) is ON (High), the source potential is $-(VW - \frac{1}{2}.VM) = -160$ V. When (NSC) is OFF (Low), the source potential is 0 V. (PSC) is a control signal for the source potential selector circuit (300) for the P-ch high voltage MOS IC's. When it is ON (High), the source potential is $VW + \frac{1}{2}.VM = 220$ V. When it is OFF (Low), the source potential is 0 V. (NTodd) is the N-ch high voltage MOS transistor in the IC (20), (NTeven) is the N-ch high voltage MOS transistor in the IC (30), (PTodd) is the P-ch high voltage MOS transistor in the IC (40), and (PTeven) is the P-ch high voltage MOS transistor in the IC (50). On/OFF Operation of these transistors in each timing is shown. In Table 4, (ON) indicates that only the selected line is turned ON. These transistors are controlled for ON, OFF or (ON) by signals ($\overline{\text{NCLodd}}$), (NSTodd), (e,ovs/NCLeven ), (NSTeven), (PCLodd), ($\overline{\text{PSTodd}}$), (PCLeven) and ($\overline{\text{PSTeven}}$). The logic for each timing is shown in Table 4.

Figure 8:
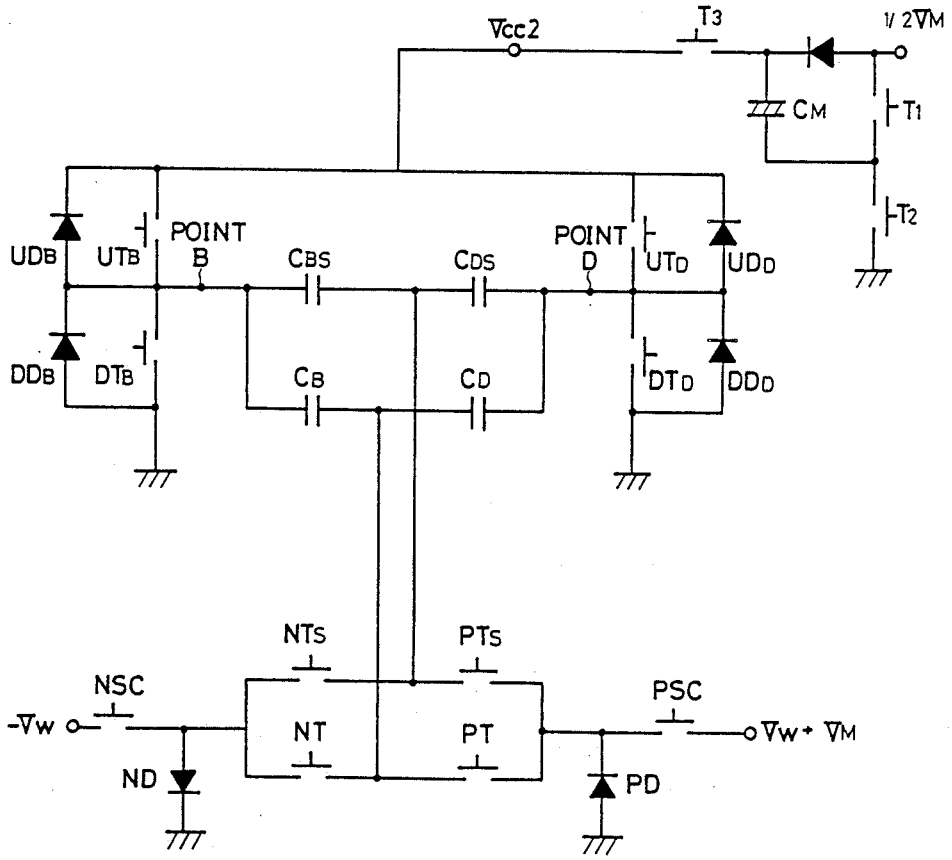
FIG. 8 is a diagram for explaining the operation of the circuit of FIG. 3 using an equivalent circuit.

Next, referring now to the equivalent circuit diagram of FIG. 3 shown in FIG. 8, the drive timing of respective elements is described below. Table 5 explains the codes appearing in FIG. 8.

TABLE 5

| Code | Description |
|---|---|
| C | Static capacity per picture element of EL element |
| B | Number of illuminated picture element on the scanning-side selected line |
| D | Number of data-side electrode |
| S | Number of scanning-side electrode |
| CBS | Synthetic capacity of the data-side selected picture element on the scanning-side selected line: B C |
| CB | Synthetic capacity of the data-side selected picture element on the scanning-side non-selected line |
| CDS | Synthetic capacity of the data-side non-selected picture element on the scanning-side selected line: (D − B) • C |
| CD | Synthetic capacity of the data-side non-selected picture element on the scanning-side non-selected line |
| Vcc2 | Common line of the data-side charging switching circuit |
| ½VM | Power supply source (one-half the modulated voltage) |
| T1 | Switch for doubling voltage |
| T2 | Switch for charging CM |
| T3 | Switch for floating Vcc2 |
| CM | Capacitor for charging double voltage |
| UTB | Denotes all the charging transistors connected to the data-side selected line |
| UTD | Denotes all the charging transistors connected to the data-side non-selected line |
| DTB | Denotes all the discharging transistors connected to the data-side selected line |
| DTD | Denotes all the discharging transistors connected to the data-side non-selected line |
| UDB | UTB-protecting diode |
| UDD | UTD-protecting diode |

TABLE 5-continued

| Code | Description |
|---|---|
| DDB | DTB-protecting diode |
| DDD | DTD-protecting diode |
| NTS | High voltage N-ch MOS transistor connected to the scanning-side selected line |
| PTS | High voltage P-ch MOS transistor connected to the scanning-side selected line |
| NT | High voltage N-ch MOS transistor connected to the scanning-side non-selected line |
| PT | High voltage P-ch MOS transistor connected to the scanning-side non-selected line |
| NSC | Switch that switches source of N-ch MOS transistor between -VW and 0 V |
| PSC | Switch that switches source of P-ch MOS transistor between VW + VW and 0 V |
| ND | Diode that normally keeps source of N-ch MOS transistor at 0 V |
| PD | Diode that normally keeps source of P-ch MOS transistor at 0 V |

First, signals (PSC) and (NSC) are turned OFF to maintain the source potentials of the N-ch and P-ch high voltage MOS transistors at 0 V, and at the same time, transistors (NTodd), (NTeven), (PTodd), and (PTeven) are all turned ON to maintain the source potential of the scanning-side electrodes at 0 V. While these operations are underway, the switch (T3) of the data side remains OFF, and the common line (Vcc2) remains in the floating state. Next, the transistor (UTB) connected to electrodes including selected picture elements is turned ON in accordance with the display data, and the transistor (DTB) is turned OFF; the transistor (UTD) connected to electrodes including non-selected picture elements is turned OFF, and the transistor (DTD) is turned ON. Since the common line (Vcc2) remains floating when each transistor operates itself so that charging can be performed in the direction opposite from the last driving operation, only discharge can be performed. If charging operations were performed in the identical direction, the charge would be held constant. In other words, discharge is performed only when a charge is applied of a specific polarity opposite from the direction in which the charge was performed in the last driving. Discharge cannot be performed when charges of identical polarity are applied.

2. Write period of the N-ch drive in the NP field

First, the signal (NSC) is turned ON to achieve -(VW $-\frac{1}{2}$VM) $=-160$ V for the source potential of the N-ch high voltage MOS transistor, and the signal (PSC) is turned OFF to maintain the source potential of the P-ch high voltage MOS transistor at 0 V. Then, in accordance with the data in the shift register (21), one line is selected from the odd-side N-ch high voltage MOS transistors (NTodd) to turn the transistor (NTS) ON, and all other N-ch and P-ch high voltage MOS transistors are turned OFF. Diodes (UTB), (UTD), (DTB), and (DTD) on the data side continue driving operations during the discharge period. The common line (Vcc2) first turns the switch (T3) ON to change from the floating state to the $\frac{1}{2}$MV state, and then switch (T2) is turned OFF, and switch (T1) is turned ON to allow the voltage to rise by itself to VM. This causes the source potential of the data-side electrodes including selected picture elements to become VM=60 V and that of non-selected electrodes to become 0 V. Since the source potential of the selected scanning-side electrodes remains at -(VW$-\frac{1}{2}$VM)$=-160$ V, the picture element (CBS) between the selected scanning-side electrodes and the selected data-side electrodes receives 60 V $--160$ V)=220 and can illuminate itself. Although the picture element (CDS) between non-selected data-side electrodes receives 0 V$-(-160$ V)=160 V, it cannot illuminate itself, as this is below the illumination threshold value. Since the scanning-side electrodes remain in the floating state, the voltage in picture elements (CB) and (CD) on the scanning-side non-selected line varies from 0 V to a maximum of 60 V, depending on the ratio of the selected and non-selected lines of the data side.

3. Discharge period of the P-ch drive in the NP field

Except for turning the data-side transistors ON and OFF in accordance with inverted display data, the drive system executes drive operations identical to those performed during the discharge period when the NP-field N-ch driving is underway.

4. Write period of the P-ch drive in the NP field

First, the signal (PSC) is turned ON to achieve VW$+\frac{1}{2}$VM=220 V for the source potential of the P-ch high voltage MOS transistor, and the signal (NSC) is turned OFF to maintain the source potential of the N-ch high voltage MOS transistor at 0 V. Then, in accordance with the data in the shift register (51), one line is selected from the even-side P-ch high voltage MOS transistor (PTeven) to turn the transistor (PTS) ON. All other N-ch and P-ch high voltage MOS transistors (PT), (NTS), and (NT) are turned OFF. The data-side transistors (UTB), (UTD), (DTB), and (DTD) continue driving operations during the discharge period. The common line (Vcc2) first turns the switch (T3) ON to change from the floating state to the $\frac{1}{2}$VM state, and then the switch (T2) is turned OFF, and the switch (T1) is turned ON to raise the voltage to VM. This causes the source potential of data-side electrodes including selected picture elements to become 0 V and that of non-selected electrodes to become VM=60 V. Since the source potential of the scanning-side electrodes remains at VW$+\frac{1}{2}$VM=220 V, the picture elements between the scanning-side electrodes and the data-side electrodes receive 220 V$-$0 V=220 V with the polarity opposite from that of the last N-ch drive operation's writing pulse so that these picture elements can illuminate themselves. Although the picture elements between non-selected data-side electrodes receive 220 V$-$60 V=160 V, they cannot illuminate themselves, as this is below the threshold value.

5. Discharge period of the P-ch drive in the PN Field

The drive system executes drive operations identical to those performed during the discharge period when NP-field P-ch driving is underway.

6. Write period of the P-ch drive in the PN field

Except for the selection of the scanning-side selection line from the odd side, the drive system executes drive operations identical to those performed during the NP-field N-ch drive operation.

7. Discharge period of the N-ch drive in the PN Field

The drive system executes drive operations identical to those performed during NP-field N-ch driving operation.

8. Write period of the N-ch drive in the PN field

Except for the selection of the scanning-side selection line from the even side and the activation of the N-ch high voltage MOS transistor of the selected line, the drive system executes drive operations identical to those performed in the NP field.

In order to drastically lower the power consumption of the modulation system, the thin-film EL display panel drive circuit of the present invention provides a specific discharge period, in which the drive circuit totally discharges the modulated voltage VM previously applied to the picture elements before applying a modulated voltage VM with the opposite polarity. Conventional EL display panel drive circuits feed a constant modulated voltage VM (V) to the common line (Vcc2). For example, in a conventional drive circuit, the value VM(V) is constant. When a charging operation in a horizontal period is executed from the state in which points B (being positive) and D in the equivalent circuit shown in FIG. 8 are charged with a modulated voltage VM (V), in the direction opposite to that of the last horizontal period, the polarity is instantly inverted before the modulated voltage VM is applied to these points. Given that the synthetic capacity between points B and D is CEL, the power consumption of the power supply source of the modulated system is denoted by the equation $PM=CEL\ (VM+VM)^2=4.CEL.VM^2$. This is because the conventional drive circuit applies a modulated voltage VM with inverted polarity while a previously charged VM still remains. In contrast, the thin film EL display panel drive circuit related to the present invention provides a specific discharge period. As a result, in applying a modulated voltage VM with inverted polarity, although each of the data-side transistors is switched, the common line (Vcc2) remains open so that the previous charge can be discharged completely to ground via transistors (DTB) and (DDD). In applying the voltage with inverted polarity, the modulation system's power consumption is denoted by $PM=CEL.VM^2$, a level only one-quarter of that required by conventional modulation systems. When voltages of identical polarity are applied, although there is a specific discharge period, no charge can be discharged since none of the data-side transistors is switched, so no power is consumed. In applying a modulated voltage VM, the drive circuit related to the present invention does not apply the modulated voltage VM all at once; it applies ½VM of voltage before eventually charging the modulation system with VM. This operation allows the modulation system to lower its power consumption to three-quarters of that required by conventional modulation systems. Conventional drive circuits feed ½VM of voltage to all of the even-side electrodes during a write period if the scanning-side selected line is designated to be the odd-side, for example. In this way, conventional drive circuits feed ½VM of voltage to the scanning-side electrodes opposite to the selected line. During this operation, each transistor is activated to charge the data-side electrodes with 0 V or 60 V in accordance with the display data. Thus, as shown in the equivalent circuit of FIG. 8, the capacitances of picture elements of the selected and non-selected lines of the data side are connected to each other in series. As the scanning-side electrodes are present between them, the potential of the scanning-side electrodes varies from 0 V to VM, depending on the capacitance ratio between the selected line and non-selected line of the data side. Consequently, since the scanning-side potential is different from that of the data side, the application of ½VM of voltage to the scanning-side non-selected line causes current to flow through the data-side electrodes, resulting in a waste of power via the modulation system. The drive circuit related to the present invention, however, causes all lines except for the scanning-side selected line to remain in the floating state throughout the write period so that no current from the modulation system can flow through the scanning-side and data-side lines. This effectively minimizes loss of power through the modulation system.

As is clear from the above description, the preferred embodiment of the present invention drastically lowers power consumption of the modulation system to one-quarter of that required by conventional modulation systems by providing a specific discharge period. In addition, by applying the modulated voltage VM via a two-step process, power consumption can be reduced to three-quarters of that required by conventional modulation systems. Furthermore, by keeping non-selected lines in the floating state, power consumption as a whole is effectively reduced to a maximum of three-sixteenths of the conventional level. As described above, in accordance with the preferred embodiment of the present invention, since the power consumption of the modulation system which shares the majority (about 70%) of the drive power can be reduced to a maximum of three-sixteenths as compared to any conventional drive circuit without substantially sacrificing advantages thus far generated by conventional systems, a novel drive circuit for a thin-film EL display panel capable of drastic power savings can be realized.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A drive circuit for a thin film electroluminescent (EL) display panel having a plurality of scanning electrodes extending in one direction, a plurality of data electrodes extending in a second direction orthogonal to said first direction, and an EL layer sandwiched therebetween, picture elements being formed at intersections of said scanning and data electrodes, the circuit comprising:

first switching circuit means connected to each of said scanning electrodes for applying a scanning voltage of negative polarity thereto;

second switching circuit means connected to each of said scanning electrodes for applying a scanning voltage of positive polarity thereto;

data electrode driver means for driving said data electrodes, including third switching means for applying a charging modulated voltage to each of said data electrodes, and fourth switching means for discharging each of said data electrodes;

fifth switching circuit means for providing said voltage of negative polarity to said first switching circuit means;

sixth switching circuit means for providing said voltage of positive polarity to said second switching circuit means;

seventh switching circuit means connected to said third switching circuit means for providing modulated voltage levels of a first value, a second value less than said first value, and a floating level to said third switching circuit means; and means for driving said EL display panel in two fields by providing signals to said first through seventh switching circuit means wherein odd numbered scanning electrodes are provided with said negative polarity voltage and even numbered scanning electrodes are provided with said positive polarity voltage in a first field, said negative and positive polarities being reversed in a second field, selected data electrodes intersecting said odd numbered scanning electrodes being sequentially provided with said second and first values of said modulated voltage levels during said first field and being discharged during said second field, and selected data electrodes intersecting said even numbered scanning electrodes being discharged during said first field and being sequentially provided with said second and first values during said second field.

2. The circuit defined in claim 1, further comprising means for discharging previously charged data electrodes in each sequential field prior to applying said modulated voltage to said data electrodes by providing said floating level to said third switching circuit means.

3. The circuit defined in claim 1, wherein said second value is equal to one-half said first value.

4. A method of driving a thin film electroluminescent (EL) display panel having a plurality of scanning electrodes extending in one direction, a plurality of data electrodes extending in a second direction orthogonal to said first direction, and an EL layer sandwiched therebetween, picture elements being formed at intersections of said scanning and data electrodes, comprising the steps of:

grouping said plurality of scanning electrodes into odd and even numbered electrodes;

driving said panel in two fields, including the step of applying a negative polarity voltage to said odd numbered electrodes and a positive polarity voltage to said even numbered electrodes in a first field and reversing said polarities in a second field;

applying a modulated voltage to data electrodes forming selected picture elements with intersecting selected scanning electrodes when said negative polarity voltage is applied thereto, said modulated voltage being applied stepwise in at least two steps;

grounding data electrodes forming non-selected picture elements with said intersecting selected scanning electrodes when said negative polarity voltage is applied thereto;

grounding data electrodes forming selected picture elements with intersecting selected scanning electrodes when said positive polarity voltage is applied thereto; and applying said modulated voltage to data electrodes forming non-selected picture elements when said positive polarity voltage is applied thereto.

5. A method of driving an electroluminescent display panel including an electroluminescent layer disposed between a group of scanning electrodes and a group of data electrodes defining pixels therebetween, said scanning electrodes being arranged in alternating odd and even groups, comprising:

(a) applying a first voltage pulse of a first polarity having sufficient voltage to cause electroluminescence to selected pixels of an odd scanning electrode;

(b) applying a second voltage pulse of a second polarity also having sufficient voltage to cause electroluminescence to selected pixels of an even scanning line adjacent said odd scanning line;

repeating said steps (a) and (b) to successive odd and even scanning lines until said first and second voltage pulses have been applied to all said scanning electrodes;

(c) applying said second voltage pulse to selected pixels of an odd scanning line;

(d) applying said first scan voltage pulse to selected pixels of an even scanning line adjacent said odd scanning line;

(e) repeating said steps (c) and (d) to successive odd and even scanning lines until said first and second voltage pulses have been applied to all said scanning electrodes;

said first and second voltage pulses supplied to each said scanning line in steps (a) and (b) having a constant phase difference from the first and second voltage pulses supplied thereto during said steps (c) and (d) on each said scanning line;

(f) forming said first and second voltage pulses in said steps (a-d) from the simultaneous application of said scan pulses on a selected said scanning line and a modulation waveform on each said data line, the sum of each said scan pulse and said modulation waveform on pixels extending along a non-selected said data line being insufficient to cause electroluminescence;

said modulation waveform supplying ground or a modulation voltage $V_M$ to each said data electrode coincident with each said scan pulse, developing said modulation voltage by developing a voltage $\frac{1}{2}V_M$ and subsequently developing said modulation voltage $V_M$ in a stepwise fashion therefrom.

6. The method of claim 5 wherein said step of developing includes doubling said voltage $\frac{1}{2}V_M$ using a voltage doubler to develop said modulation voltage $V_M$.

* * * * *